US006220870B1

(12) United States Patent
Barabi et al.

(10) Patent No.: US 6,220,870 B1
(45) Date of Patent: Apr. 24, 2001

(54) IC CHIP SOCKET AND METHOD

(75) Inventors: Nasser Barabi, Lafayette; Siamak Jonaidi, San Jose, both of CA (US)

(73) Assignee: Cerprobe Corporation, Hayward, CA (US)

( * ) Notice: Subject to any disclaimer, the term of this patent is extended or adjusted under 35 U.S.C. 154(b) by 0 days.

(21) Appl. No.: 09/032,361

(22) Filed: Feb. 27, 1998

(51) Int. Cl.[7] ..... H01R 12/00

(52) U.S. Cl. ..... 439/71

(58) Field of Search ..... 439/71, 73, 331

(56) References Cited

U.S. PATENT DOCUMENTS 5,395,254 * 3/1995 Mogi ..... 439/71
5,518,410 * 5/1996 Masami ..... 439/71
5,791,914 * 8/1998 LOranger et al. ..... 439/71

* cited by examiner

*Primary Examiner*—Tulsidas Patel
(74) *Attorney, Agent, or Firm*—Donald L. Beeson

(57) ABSTRACT

An I/C chip socket is provided with a separate docking platform having a seating surface with an array of locator openings for receiving and fixing the position of the I/O contacts of an I/C chip such as the solder balls of a BGA. The docking platform is depressibly mounted in the base portion of the socket over the tips of an array of pogo pins. The docking platform acts to precisely center the I/O contacts of the I/C chip seated thereon with the pogo pin tips.

17 Claims, 6 Drawing Sheets

37
18
15
55
53
69
43
43
53
41
45
13
45
59
39
49
61
61
17
11
29
25
107
31
14
19
25
12
27
47
51
47
47
57
47
23
25
63
52
19
29
73
19
25
z
y
x

IC CHIP SOCKET AND METHOD

BACKGROUND OF THE INVENTION

The present invention generally relates to achieving electrical interfaces between two conductive paths, and more particularly to the construction of sockets for holding the I/O contacts of an IC chip in electrical contact with the compliant tips of an array of conductive probes, typically pogo pin probes. The invention has particular application in contacting ball grid array (BGA) devices wherein electrical contact must be achieved within an array of densely packed solder balls. However, the socket and method of the invention can also be used in connection with IC chips having other contact or lead formations.

Sockets for holding IC chips are well known and widely used in a variety of industrial applications for achieving efficient electrical contact between the I/O contacts of an IC chip and the conductors of a connector, circuit board or the like. Such applications include test sockets for testing IC devices and contactor sockets for removably mounting an IC device to a printed circuit board. The basic function of the socket is to hold the IC chip in a fixed position such that its array of I/O contacts, eg. the solder balls of a BGA, can be contacted by the compliant tips of a corresponding pogo pin array to produce a desired electrical connection. Precise centering of the pogo pins relative to the chip's I/O contacts is critical to this function and generally to the electrical and mechanical performance of the socket. Any misalignment between the pogo pin tips and the I/O contacts can result in a poor electrical interface to the IC chip. Distortion of the I/O contacts can also result when misalignments produce off-center contacts.

In a conventional IC socket, an IC chip is held in a socket base directly over an array of pogo pins. In such socket designs, the chip's I/O contacts are typically centered by referencing the known lateral dimensions of the IC package to the sidewalls of the socket base in which the IC chip is held. The difficulty with this centering approach is that the true position of the I/O contacts within the socket are subject to usual variations that occur in the dimensions of the IC package. The resulting deviations from a true center detrimentally affects the electrical performance of the socket and increases undesirable deformations in the chip's contacts. The problem of contact deformation is particularly acute in BGA devices where deformations in the device's solder balls can detrimentally affect the inspection of the IC device as well as the assembly of the device onto a printed circuit board. Excessive deformation of the extremely small solder balls of micro-BGAs can, for example, cause such IC devices to be rejected during quality control procedures which typically employ laser or other inspection techniques.

Another drawback of conventional IC socket designs is the need to apply a modicum of force to disengage the IC chip from the pogo pins upon removal of the IC chip from the socket. Generally, the tips of the pogo pin probes will, to a certain degree, indent, displace or disturb the chip's I/O contacts, creating a binding force between the chip and pogo pins which must be overcome upon removal. The need therefore exists for an IC socket where the removal of the chip from the pogo pin tips can be facilitated.

The present invention provides an improved IC socket design and method that overcomes the aforementioned drawbacks of conventional IC sockets. The improved IC socket and method of the invention reduces chip positioning errors and more particularly permits extremely accurate centering of the chip's I/O contacts over the tips of the socket's pogo pins. The invention also facilitates the removal of the chip from the IC socket.

SUMMARY OF THE INVENTION

Briefly, the invention herein described and claimed involves a socket which holds an IC chip having lateral edges and a planar array of I/O contacts. The socket is comprised of a base portion having a defined z-axis, and a separate chip docking structure for receiving the IC chip and for fixing the position of the chip's planar array of I/O contacts in an x-y plane perpendicular to the z-axis of the base portion, without reference to the lateral edges of the IC chip. In the preferred embodiment, the docking structure of the socket is provided in the form of a docking platform having a chip-seating surface extending in the x-y plane. This seating surface has an array of locator openings for receiving the chip when the chip is seated on the seating surface with its I/O contacts engaged in the locator openings. The position of the chip's I/O contacts is therefore fixed in the x-y plane in reference to the I/O contacts themselves, without reference to the lateral edges of the chip. Furthermore, the seating plane of the chip docking structure, which is contacted by the underside of the chip package, provides a reference plane for the chip that has relatively true planarity as compared to the planarity of the seating plane of the I/O contacts. Thus, the IC chip will be held within the socket in the true x-y plane established by the chip docking structure.

The socket of the invention also provides for an array of conductive probes which are held in the socket base in opposition to the chip docking structure. The array of conductive probes are configured to correspond to a standardized configuration of I/O contacts of an IC chip. Specifically, the probes have compliant probe tips arrayed in an x-y plane so that the probe tips and the I/O contacts held on the chip docking structure are centered relative to each other in the direction of the z-axis of the socket base. In the preferred embodiment, the probe array is held in a fixed transverse bottom wall of the socket's base portion. However, it will be understood that the probe array can be provided beneath the docking structure by other means, such as a separate probe retention structure that moves within the socket base or that externally connects to the socket base.

The socket of the invention further includes z-axis closure means for operatively bringing the I/O contacts of the IC chip held on the docking structure into contact with the compliant probe tips of the conductive probe array opposed thereto by a relative movement of the contacts and probe tips along the z-axis of the base portion. It is particularly contemplated that the chip docking structure will be movable relative to the probe tip array along the z-axis by providing a docking structure that is depressible in the z-axis against spring supports in the socket base. In the illustrated embodiment of the invention, the docking structure is provided in the form of a rectangular docking platform which is depressibly captured in the socket base along its four corners by means of corner blocks. The corner retention of the docking platform will inhibit any rotational movement of the docking platform in the base portion which would cause positional errors of the outermost I/O contacts of the IC chip seated on the platform.

The invention also involves a method for bringing the I/O contacts of an IC chip into contact with the compliant tips of an interface probe array. The method is generally comprised of fixing the position of the planar array of I/O contacts of an IC chip in the x-y plane in direct reference to the I/O contacts, and providing an array of probes having probe tips centered to such known fixed reference position. The centered probe tips and the I/O contacts of the I/C chip are brought into contact along the z-axis, preferably by moving the IC chip relative to the probe tips.

Therefore, it can be seen that a primary object of the present invention is to provide an IC socket and a method for centering the I/O contacts of an IC chip over the compliant tips of a probe array with minimal positional error. It is a further object of the invention to provide a test socket and method which permits the IC chip to self-release from the probe array upon removal of the IC chip from the test socket. Other advantages of the invention will be apparent from the following specification claims, as well as the accompanying drawings.

DETAILED DESCRIPTION OF THE ILLUSTRATED EMBODIMENT

Figure 1:
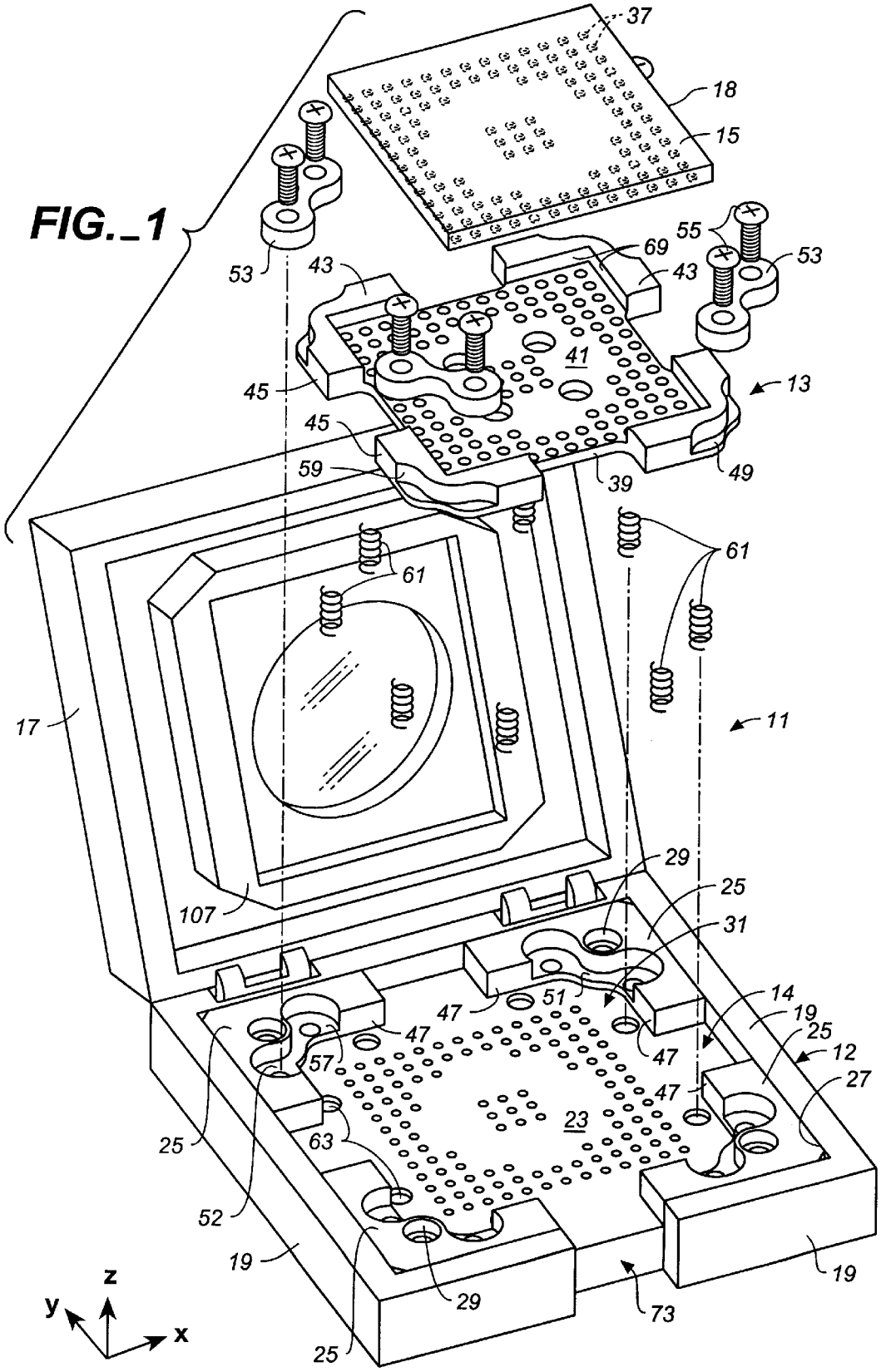
FIG. 1 is an exploded, top perspective view of an improved IC chip socket in accordance with the invention, showing an IC chip positioned over the docking platform of the socket. The pogo-pin probes in the socket base have been omitted in the figure for illustrative purposes.
Figure 2:
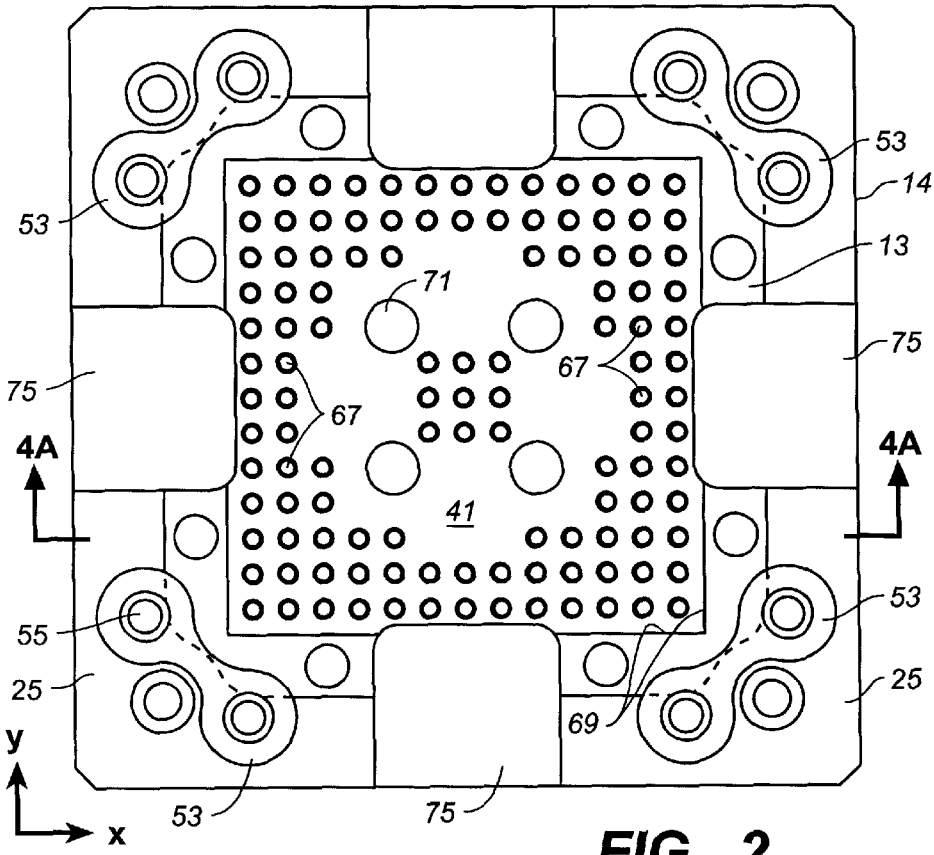
FIG. 2 is a top plan view of the base portion of the socket shown in FIG. 1 with the docking platform retained therein.

Referring now to the drawings, FIGS. 1 and 2 illustrate an IC chip socket 11 in accordance with the invention for holding an IC chip such as a BGA 15 having a planar array of solder ball contacts 37. The test socket includes an outer frame 12, a base portion 14 held within the outer frame, and a docking structure in the form of docking platform 13. The outer frame has right angle perimeter walls 19 generally defining a rectangular socket perimeter, and a cover portion 17. The base portion, in turn, has a transverse bottom wall 23 extending in the x-y plane of the x-y-z coordinate system of the base portion shown in FIGS. 1 and 2. Corner blocks 25 are provided at the four corners of the base portion inside the interior corners 27 of the frame to form a generally rectangular central cavity region 31 over the transverse bottom wall 23. This cavity region receives the similarly shaped docking platform 13 whose function it is to receive the BGA 15, and, as hereinafter described, to fix the position of the BGA's solder ball array 37 in the test socket.

While illustrated and described as two separate parts, it will be appreciated that frame 17 and base portion 14 can be fabricated as a single base unit with a hinged or separate cover, all of which could suitably be molded plastic parts. It is also contemplated that the corner blocks 25 of base 14 can be provided as separate elements that are detachable from the base. This would allow different sized docking platforms to be used with the socket as herein described.

The docking platform is seen to include a transverse support wall 39 having a planar, rectangular IC chip seating surface 41 extending in the x-y plane, that is, in a plane perpendicular to the z-axis of socket base 14. Raised corner guides 43 formed at the four corner positions of the docking platform provide a means for slidably retaining docking platform 13 within the center cavity region of the socket base. More specifically, it is seen that each of the raised corner guides of the docking platform includes right angle outer guide walls 45 and a curved bottom lip 49 which nest within the right angle inner guide walls 47 and curved edge 51 of the corner blocks. Curved retainer clip recesses 52 in the top of the corner blocks 25 receive correspondingly shaped corner retainer clips 53 which are removably fastened in the clip recesses by means of screw fasteners 55. The bottom wall 57 of each clip recess has a thickness suitably greater than the curved bottom lip 49 of the platform's corner guides to allow the platform suitable freedom of travel along the z-axis when the retainer clips bottom out against the recessed bottom wall. The retainer clips slidably engage the shaped corner guide surfaces 59 on the platform's raised corner guides 43 to fix the position of the platform in the socket base. Such corner retention of the docking platform also inhibits rotational movements which would lead to positional errors. The positional integrity of the docking platform is further enhanced by the double curved shape of the corner retainer clips and guide surfaces 59 which maximize the contact area at the corners.

Figure 3:
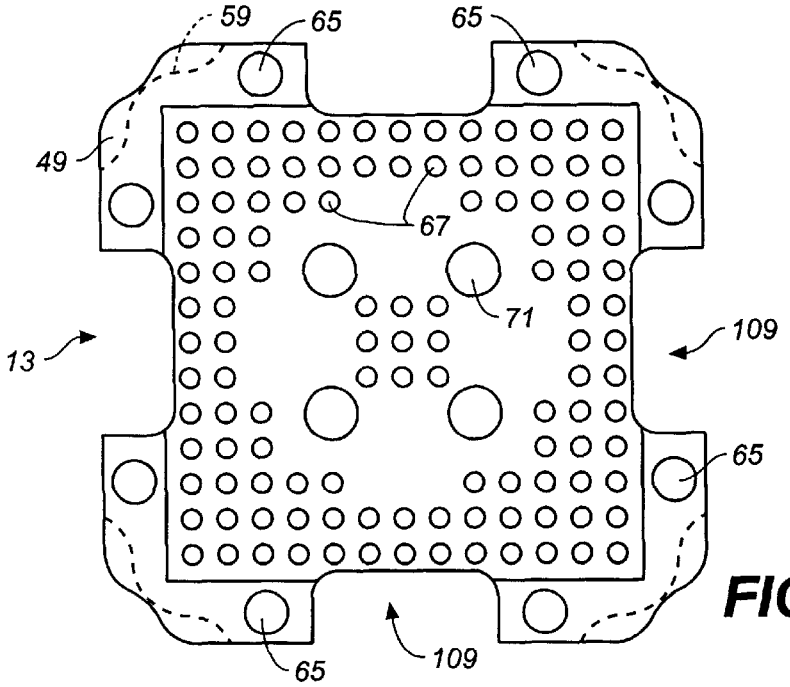
FIG. 3 is a bottom plan view of the docking platform of the test socket shown in FIGS. 1 and 2.

As best illustrated in FIG. 1, the docking platform is supported on the transverse bottom wall of the socket's base portion by means of a series of compression springs 61 provided at the four corners of the docking platform. Suitably, two compression springs are provided at each corner adjacent corner blocks 25 to provide evenly distributed support of the docking platform in the center cavity region 31 of the socket base. To hold the compression springs in place, the bottom ends of the compression springs are retained within recesses 63 in the interior surface of the bottom wall of the socket base, while the top ends of the compression springs are retained in corresponding opposed recesses 65 in the bottom of the docking platform (see FIG. 3). The compression spring supports will permit the docking platform to be depressed along the z-axis of the socket base within the base corner blocks 25, thereby providing z-axis closure means for bringing the BGA seated on the docking platform into electrical contact with the socket probes as herein described. It will be appreciated that other forms of spring supports could be provided for the docking platform, for example, leaf spring supports.

With further reference to FIG. 1, it can be seen that the docking platform 13 is installed in the center cavity region 31 of the socket base 14 by slidably engaging the raised corner guides 43 of the docking platform within the base's respective corner block 25, and then by screwing the corner retainer clips 53 down into the clip recesses 52 of the corner blocks. The retainer clips are screwed down into the corner block recesses to capture the bottom lip 49 of the platform's raised corner guides. Separate counter-bored screw holes 29 in the corner blocks provide a means for fastening the socket to a circuit board.

It should be noted that docking platforms having different design characteristics for different applications can readily be exchanged in the socket base 14 by removing the corner retaining clips 53 and replacing the docking platform. Further, if required, and as above-mentioned, the corner blocks of the socket base could themselves be designed to be removable so that they could be exchanged to meet different design requirements for the outer perimeter of the docking platform. However, it is contemplated that a universal docking platform could be provided for accommodating a variety of IC chip designs, such as BGAs having different solder ball densities.

To precisely position the solder balls of the BGA on the docking platform, the chip seating surface 41 includes an array of locator openings 67 sized to receive the solder balls 37 of the BGA chip 15 when the BGA chip is seated against this seating surface. Preferably, locator openings 67 are circular openings having a diameter somewhat larger than the mean diameter of the solder balls so as to accommodate all of the solder balls of the chip's solder ball array, but not so large as to permit undue lateral movement of the BGA on the seating surface of the platform. When seated on the platform seating surface, the position of the BGA will be fixed in reference to these openings, as opposed to referencing the BGA package itself. In this connection, it is noted that the right angle interior walls 69 of the platform's corner guides 43 should provide suitable lateral interior dimensions at the corner of the platform to accommodate the lateral edges 18 of the BGA package without interference, since contact with the edges of the package would adversely affect the ability of the BGA's solder balls to seat properly in the platform's locator openings.

In addition to the locator opening array 67, a number of larger vent holes 71 (see FIG. 2) are suitably provided in the platform's support wall 39 to permit passage of air through the docking platform when it is depressed in the center cavity region of the socket base. Trapped air between the transverse bottom wall 23 of the socket base and the docking platform is also permitted to escape through a relief channel 73 in the perimeter of the socket base and outer frame 12.

Figure 4A:
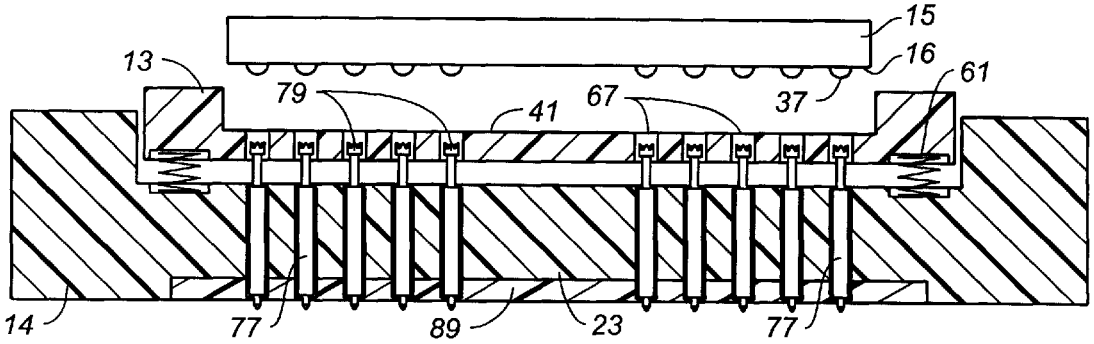
FIG. 4A is a cross-sectional view of the base portion and docking platform shown in FIG. 1 taken along section lines 4—4 in FIG. 2, and showing the pogo pin probes in the socket base and the positioning of an IC chip above the docking platform.
Figure 4B:
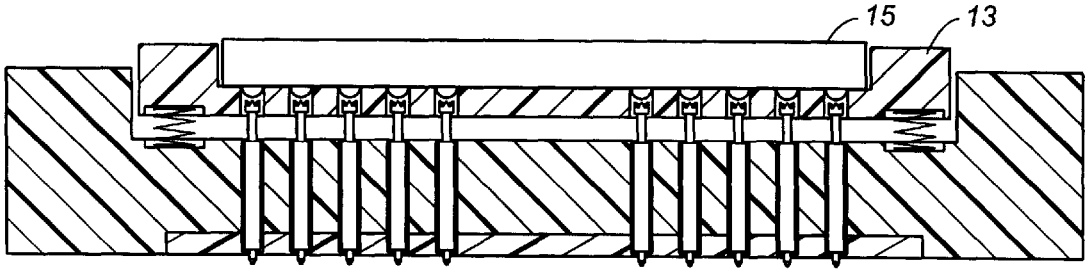
FIG. 4B is another cross-sectional view thereof in side elevation, showing the IC chip placed on the docking platform.
Figure 4C:
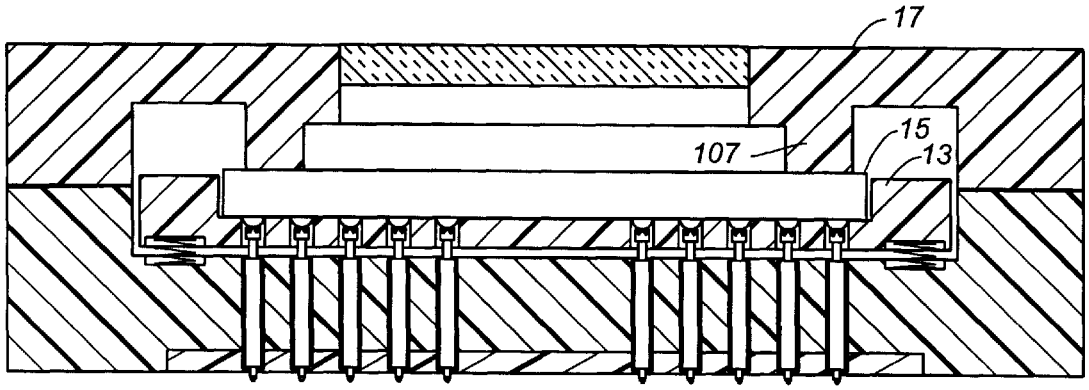
FIG. 4C is another cross-sectional view thereof in side elevation, showing the IC chip and docking platform depressed toward the socket's pogo pin probe tips.
Figure 5A:
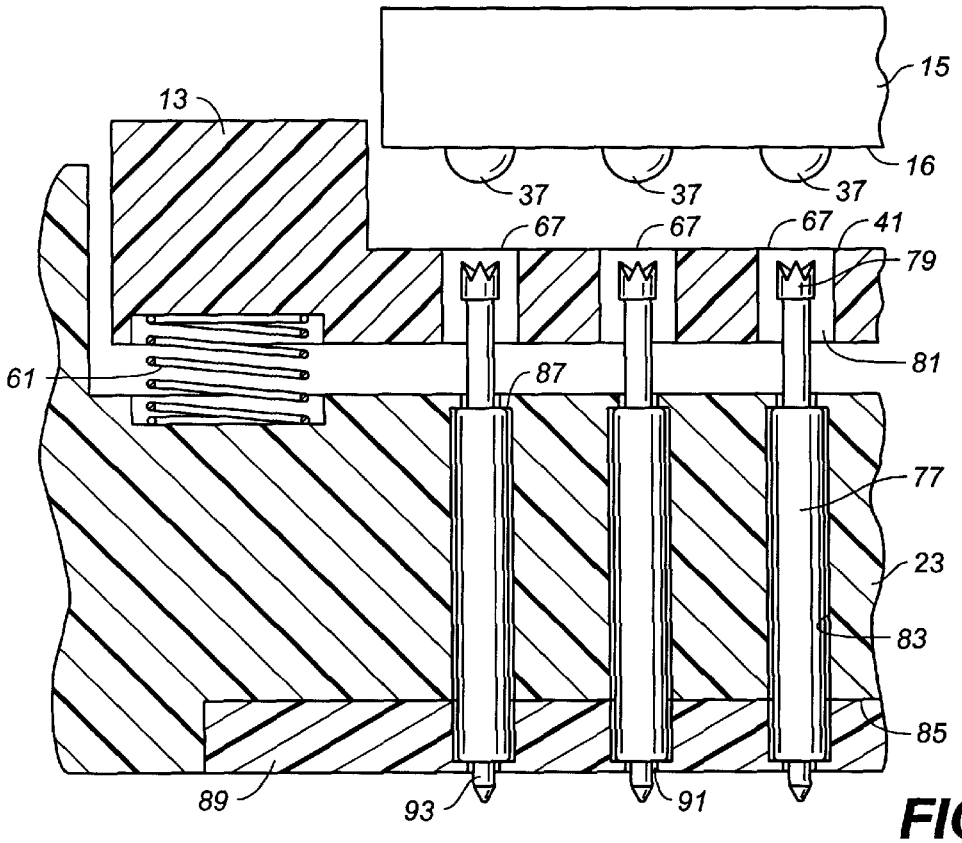
FIG. 5A is an enlarged fragmentary cross-sectional view of the socket base, docking platform, and IC chip shown in FIG.4A.
Figure 5B:
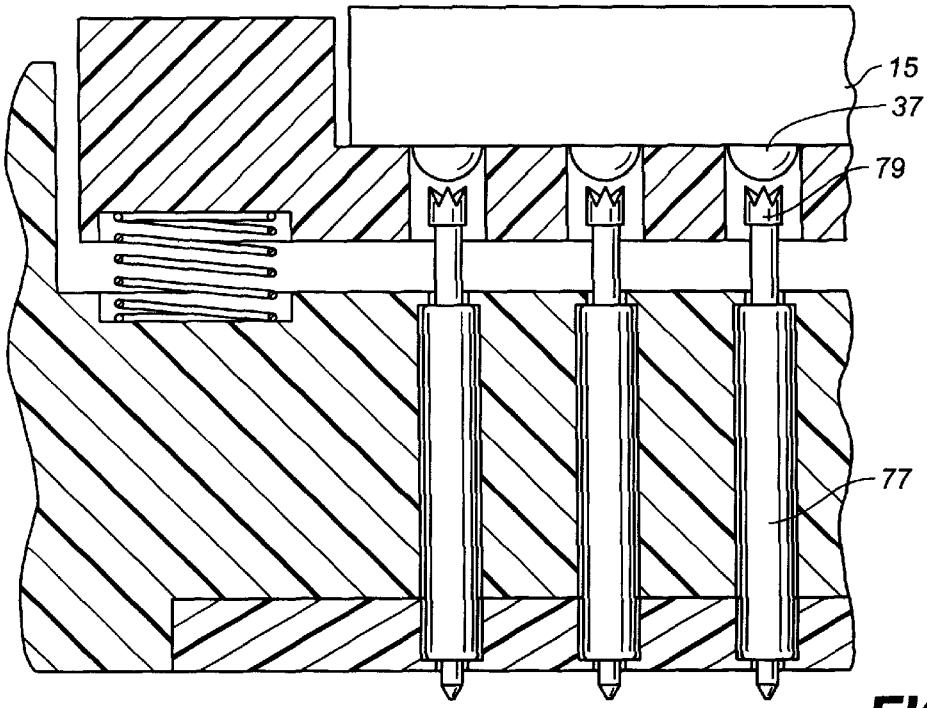
FIG. 5B is an enlarged fragmentary cross-sectional view of the socket base, docking platform, and IC chip shown in FIG. 4B.
Figure 5C:
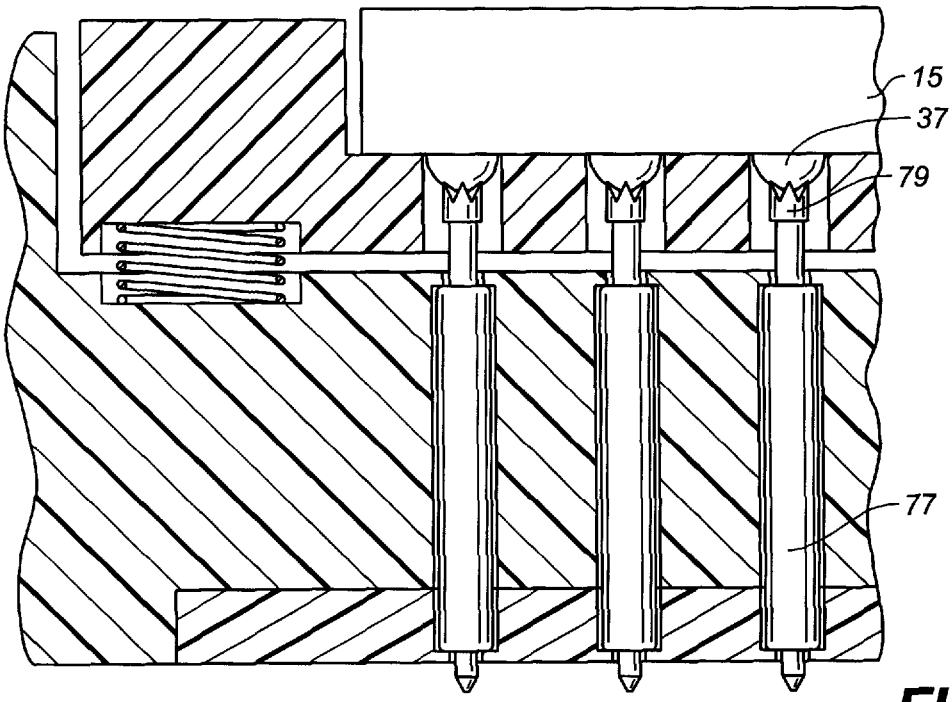
FIG. 5C is an enlarged fragmentary cross-sectional view of the socket base, docking platform, and IC chip shown in FIG. 4C.

As best illustrated in FIGS. 4–6, the socket of the invention is provided with an array of conductive probes 77 which provide an array of compliant probe tips 79 in opposition to the docking platform 13 and the planar solder ball array 37 of the BGA 15 seated on the seating surface 41 of the docking platform. To accommodate the probe tip array, the transverse support wall 39 of the docking platform is provided with a corresponding array of guide holes 81 extending through the support platform to the locator openings 67. The guide holes are sized to receive the probe tips so that the BGA solder balls 37 registered in the platform's locator openings are contacted by the probe tip array as the docking platform is depressed toward the probe tips. The individual pogo pins of the probe array are, in turn, positioned and held in their desired z-axis orientation by the transverse bottom wall 23 of the socket base. As best shown in FIGS. 5A–5C, the pogo pins of the pogo pin probe array are removably retained in the base's bottom wall by inserting them into suitably dimensioned probe retainer holes 83 from the outer side 85 of the bottom wall. When fully inserted, the pogo pin probe tips 79 will extend from the bottom wall into the bottom of the docking platform through apertures 87 at the end of retainer holes 83. The pogo pins are held in place in the retainer holes by means of a retainer cap 89 suitably secured in place over the back ends of the retainer holes by pan head screws (not shown). The pogo pin retainer cap 89 is provided with apertures 91 to accommodate probe tips 93 extending from the opposite ends of the pogo pins.

Figure 6A:
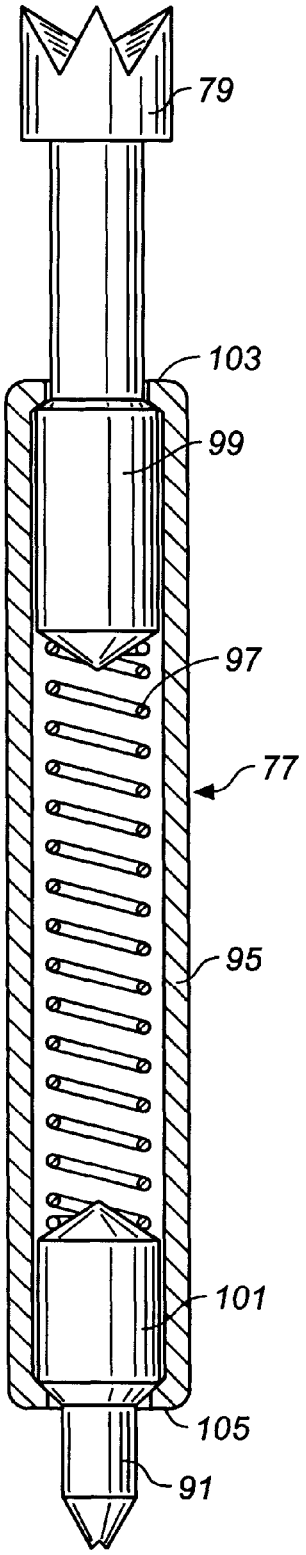
FIG. 6A is a side elevational view, in partial cross-section, of one of the pogo pin probes of the IC socket.
Figure 6B:
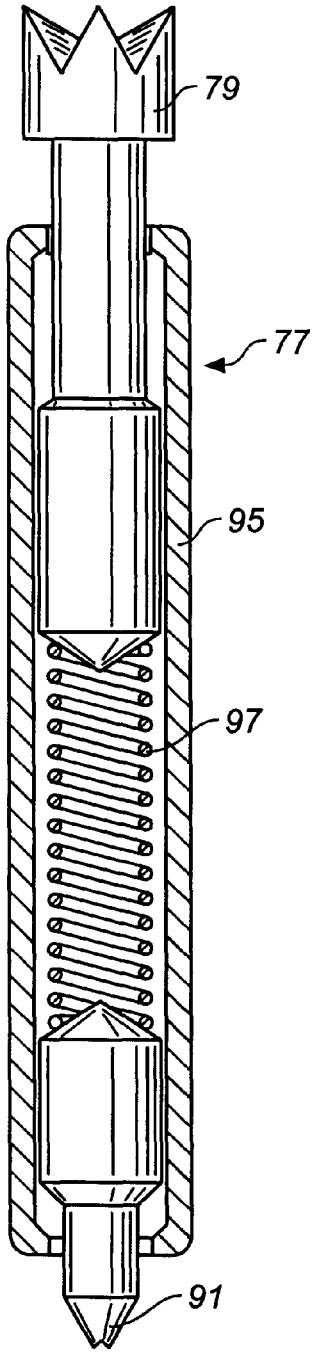
FIG. 6B is another side elevational view thereof showing the compliant probe tips of the pogo pin depressed against the pogo pin's internal compression spring.

The general construction of the pogo pins used in the pogo pin probe array of the invention is illustrated in FIGS. 6A and 6B. Each pogo pin probe 77 includes an elongated spring barrel 95, a compression spring 97, and opposed probe tips 79, 91, which extend from piston ends 99, 101 captured inside the crimped ends 103, 105 of the spring barrel. The internal compression spring 97 is compressed between the piston ends of the probe tips to hold the probe tips in their normally extended position as shown in FIG. 6A. When the probe tips are contacted, they will depress against the restoring force of the compression spring as shown in FIG. 6B, so that the probe tips operatively provide compliant spring contacts when the socket is used.

It will be understood that, while the pogo pins opposing the docking platform of the invention are shown as being stationary relative to the docking platform, it would be possible to supply the pogo pin array in a floating structure within the socket base, or to even provide for the attachment of a separate pogo pin array component to the end of the socket in proper opposition to the docking platform. In either case, the pogo pin array must be configured and positioned such that the extending probe tips 79 of the pogo pin array register with the array of guide holes 81 in the docking platform.

The use and operation of the improved socket of the invention, along with the method of the invention, is now described in reference to FIGS. 4 and 5 of the drawings. To operatively insert BGA 15 in socket 11, the BGA chip is positioned over seating surface 41 of the docking platform with the chip's solder ball contacts 37 generally aligned with the locator openings 67 in the seating surface. As shown in FIGS. 4B and 5B, the BGA is then placed on the seating surface of the platform such that its solder balls are received in the locator openings, and such that the bottom surface 16 of the BGA seats against the platform's seating surface. The BGA will thus be precisely positioned on the docking platform in reference to its solder ball contacts. Also, thusly seated, the orientation of the BGA relative to the x-y seating plane will be determined by the seating surface of the platform instead of the bottoms of the solder balls. Once the BGA is properly seated on the docking platform, the BGA and docking platform are depressed as a unit along the z-axis of the socket base against the platform's support springs 61 as shown in FIGS. 4C and 5C. Referring to FIG. 1, the BGA and docking platform are depressed toward the probe tip array by closing the socket cover 17 over the unit's outer frame 12. When the socket cover is closed, a depressor ring 107 formed on the inside of the cover contacts the top of the BGA and depresses the BGA and docking platform together as a unit. The depressor ring should be sized to standard BGA package dimensions to limit the z-axis travel of the docking platform and BGA. The degree of travel should be sufficient to permit the probe tips of the probe tip array to contact the solder balls, yet not so great as to cause the bottom of the docking platform to bottom out against the bottom wall of the socket base.

It should be noted that, when the socket is opened by opening the socket cover 17, the support springs 61 for docking platform 13 will automatically return the docking platform to its non-depressed position. As this occurs, the mechanical contact between the array of probe tips 79 and the BGA solder ball contacts 37 will be broken permitting the chip to be easily lifted off the docking platform. Removal of the chip from the platform is further facilitated by providing access openings 109 (see FIG. 3) around the perimeter of the docking platform between the platform's raised corner guides.

Figure 7:
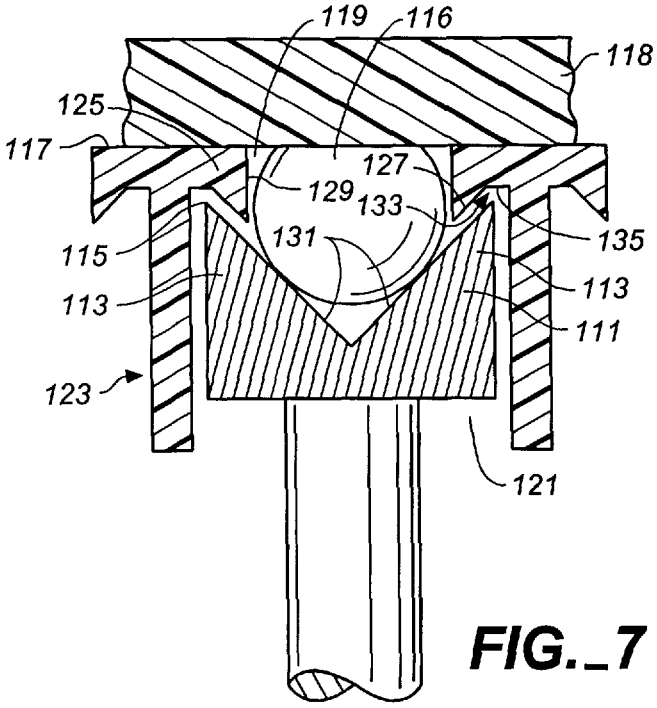
FIG. 7 is a fragmentary cross-sectional view of the docking platform of the invention showing an alternative embodiment thereof.

FIG. 7 is an enlarged fragmentary view of a portion of the docking platform showing an alternative design for the platform's locator openings and guide holes. The design of FIG. 7 is particularly adapted for use with an improved probe tip design wherein the probe tips 111 are provided with perimeter point structures 113 having point ends 115 lying on a perimeter circle that exceeds the diameter of the solder balls 116 of BGA 118. In this design, the seating surface 117 of the docking platform has locator openings 119 which are smaller in diameter than the probe tip guide holes 121 extending through the platform's bottom wall 123. The guide holes are cylindrical to conform to the cylindrical shape of the probe tip 111 and terminate at annular shoulders 125 that form the locator openings. This platform design can thus accommodate the larger diameter probe tip while providing solder ball locator openings in the platform seating surface that are optimally sized to receive and to precisely fix the position of the solder ball contacts. The annular tapered extension 127 provided at the inside diameter of the annular shoulder 125 acts to extend the interior walls 129 of the locator opening while accommodating the point ends 115 of the probe tip when the probe tip and solder ball are brought into contact with each other. Specifically, it is seen that the interior contact edges 131 of the four probe tip point structures 113 (see the probe tip 79 shown in FIGS. 6A and 6B), are the only portions of the probe tip that contact the solder ball as the BGA and docking platform are depressed toward the probe tip as above described. As the probe tip comes into contact with the solder ball, the point ends of the probe tip are accommodated by the recesses 133 formed by the tapered extensions of the annular shoulder. Furthermore, the annular interior surface 135 provided on the annular shoulder to the outside of the tapered extension will provide a stop for the point ends of the probe tip, thereby preventing excess penetration of the probe tip into the solder ball. Thus, the docking platform design illustrated in FIG. 7 will also act to minimize undesirable deformations in the solder ball.

The socket base 14, docking platform 13, and socket cover 17 are all suitably fabricated of a high temperature plastic such as TORLON®, available from Amoco Polymers, Inc. The outer frame 12 is suitably fabricated of metal or plastic and as above mentioned can be incorporated as a part of the socket base.

Therefore, it has been seen that the present invention provides a socket for an IC chip wherein the ability to precisely center the I/O contacts of the IC chip with an array of compliant probe tips associated with the socket is greatly increased over conventional socket designs. The invention also permits the use of a IC chip docking structure that can be adapted to IC chips having different contact densities. Still further, the socket of the invention provides a means for automatically releasing the IC chip from the probe tip array when the socket is opened. While the improved socket and method of the invention has been described in considerable detail in the foregoing specification, as well as in the accompanying drawings, it shall be understood that it is not intended that the invention be limited to such detail, except as necessitated by the following claims.

We claim:

1. A socket for holding an integrated circuit (IC) chip having lateral edges and a planar array of I/O contacts, said socket comprising:

a base portion having a transverse bottom wall extending in an x-y plane and a defined z-axis perpendicular to said x-y plane, raised corner block structures on the bottom wall of said base portion, said corner block structures defining a central cavity region over said bottom wall a chip docking structure in the central cavity region of said base portion for receiving the IC chip and for fixing the position of the planar array of I/O contacts thereof in an x-y plane perpendicular to the z-axis of said base portion without reference to the lateral edges of the IC chip, said chip docking structure having corner guides which engage the raised corner block structures on said base portion such that the corner block structures on the base portion fix the position of the docking structure in the x-y plane while permitting movement of the docking structure along the z-axis, an array of conductive probes held in the transverse bottom wall of said base portion in opposition to said chip docking structure and being configured in correspondence to the I/O contacts of the IC chip held on said docking structure, said array of probes having compliant probe tips arrayed in an x-y plane so that said probe tips and the I/O contacts of the IC chip held on said chip docking structure are centered relative to each other in the direction of the z-axis of said base portion, and z-axis closure means for operatively bringing the I/O contacts of the IC chip held on said docking structure into contact with the compliant probe tips of said opposed conductive probes along the z-axis of said base portion after the position of the IC chip is fixed by said docking structure.

2. The socket of claim 1 wherein said chip docking structure is comprised of a docking platform having an IC chip seating surface extending in an plane perpendicular to the base portion's z-axis, an array of locator openings in said seating surface for receiving and fixing position of the planar array of I/O contacts of an IC chip seated on said seating surface, and an array of z-axis probe guide holes extending through said docking platform behind said locator openings for receiving said array of probe tips and for allowing said probe tips to contact the array of chip I/O contacts received in said locator openings upon closure of the z-axis closure means.

3. The socket of claim 2 wherein the locator openings in the seating surface of said docking platform are smaller than the guide holes provided therein for said probe tips.

4. The socket of claim 3 wherein the probe tip guide holes in said docking platform terminates to form an annular shoulder at the seating surface of said docking platform, and wherein said annular shoulder forms the locator openings in said seating surface.

5. The socket of claim 4 wherein said annular shoulder has an inward extension portion at the locator opening to increase the depth of the shoulder at said locator opening.

6. A socket for an integrated circuit (IC) chip having an array of I/O contacts on one side thereof, said socket comprising:

a base portion having a transverse bottom wall extending in an x-y plane and a defined z-axis perpendicular to said x-y plane, raised corner block structures on the bottom wall of said base portion, said corner block structures defining a central cavity region over said bottom wall, an IC chip docking platform disposed in the central cavity region of said base portion in an x-y plane perpendicular to said z-axis and being depressable in said base portion in the direction of said z-axis, said chip docking structure having corner guides which engage the raised corner block structures on said base portion such that the corner block structures on the base portion fix the position of the docking structure in the x-y plane while permitting movement of the docking structure along the z-axis, and said docking platform having an IC chip seating surface extending in an plane perpendicular to the base portion's z-axis, an array of locator openings in said chip seating surface for receiving and fixing the position of the planar array of I/O contacts of an IC chip seated on said seating surface, and an array of z-axis probe guide holes extending through said docking platform behind said locator openings for receiving an array of probe tips positioned below said I/O contacts and for allowing said probe tips to contact the array of chips I/O contacts received in said locator openings when said docketing structure is depressed.

7. The socket of claim 6 wherein spring means are disposed between said base portion and said docking platform for depressibly supporting the docking platform in said base portion.

8. The socket of claim 6 further comprising a cover for releasibly holding an IC chip against the inner seating surface of said docking platform.

9. The socket of claim 8 wherein said cover includes a depressing member formed to contact the IC chip seated on said docking platform and depress said IC chip and docking platform in the direction of the base portion's z-axis.

10. The socket of claim 9 further comprising an outer perimeter frame surrounding said base portion and wherein said cover is hinged to said outer perimeter frame.

11. The socket of claim 6 wherein said base portion includes a transverse bottom wall perpendicular to the base portion's z-axis and extending beneath said docking platform and an array of conductive probes held in and extending through said bottom wall, said probes including compliant tips projecting from the bottom wall of the base portion into the guide holes of said docking platform to a position that allows the I/O contacts of the IC chip to come into contact with the probe tips when the IC chip docking structure is depressed.

12. A docking platform for holding an integrated circuit (IC) chip having lateral edges and a planar array of I/O contacts in an IC socket, said docking platform comprising a planar IC chip seating surface, an array of locator openings in said chip seating surface for receiving and fixing position of the planar array of I/O contacts of an IC chip seated on said seating surface, and an array of z-axis probe guide holes extending through said docking platform behind said locator openings for receiving said array of probe tips and for allowing said probe tips to contact the array of chip I/O contacts received in said locator openings, the locator openings in the seating surface of said docking platform being smaller than the guide holes provided therein for said probe tips, and the probe tip guide holes in said docking platform terminating before said seating surface to form an annular shoulder at the seating surface of said docking platform wherein said annular shoulder forms the locator openings in said seating surface, said annular shoulder having an inward extension portion at the locator opening to increase the depth of the shoulder at said locator opening.

13. A socket for holding an integrated circuit (IC) chip having lateral edges and a planar array of I/O contacts, said socket comprising:

a base portion having a defined z-axis, docking platform having an IC chip seating surface extending in an plane perpendicular to the base portion's z-axis, an array of locator openings in said seating surface for receiving and fixing position of the planar array of I/O contacts of an IC chip seated on said seating surface, and an array of z-axis probe guide holes extending through said docking platform behind said locator openings for receiving said array of probe tips and for allowing said probe tips to contact the array of chip I/O contacts received in said locator openings upon closure of the z-axis closure means, the probe tip guide holes in said docking platform terminating before said seating surface of said docking structure to form an annular shoulder at said seating surface, said annular shoulder forming locator openings in said seating surface which are smaller than said guide holes and having an inward extension portion at the locator opening to increase the depth of the shoulder at said locator opening, an array of conductive probes held in said base portion in opposition to said chip docking structure and being configured in correspondence to the I/O contacts of the IC chip held on said docking structure, said array of probes having compliant probe tips arrayed in an x-y plane so that said probe tips and the I/O contacts of the IC chip held on said chip docking structure are centered relative to each other in the direction of the z-axis of said base portion, and z-axis closure means for operatively bringing the I/O contacts of the IC chip held on said docking structure into contact with the compliant probe tips of said opposed conductive probes along the z-axis of said base portion after the position of the IC chip is fixed by said docking structure.

14. The socket of claim 1 wherein said corner block structures are removable from said base portion to permit substitution of corner blocks to accommodate docking structures of different sizes.

15. The socket of claim 1 wherein each of the corner guides on said docking structure includes an outer guide wall and an bottom lip extending perpendicularly from said outer guide wall, and wherein each corner block structure of said base portion includes a removable retainer clip extending over and loosely capturing the bottom lip of said corner guides so as to permit z-axis movement of the docking structure, each said retainer clip further slidably engaging the outer guide wall of the docking structure's corner guides for fixing the position of said docking structure in the x-y plane.

16. The socket of claim 15 wherein the outer guide wall of said docking structure corner guides has a double curved shape and wherein the retainer clip of said corner block structures have a corresponding double curved shape.

17. The socket of claim 1 wherein said docking structure has a generally rectangular shape with four corners and with a corner guide at each corner, and wherein four guide block structures are provided on said base portion for engaging the corner guides at the four corners of said docking structure.

* * * * *